US009925446B2

(12) United States Patent
Vo

(10) Patent No.: US 9,925,446 B2
(45) Date of Patent: Mar. 27, 2018

(54) DEVICE FOR COMBATIVE SPORTS TRAINING

(71) Applicant: Christopher Vo, Everett, WA (US)

(72) Inventor: Christopher Vo, Everett, WA (US)

( * ) Notice: Subject to any disclaimer, the term of this patent is extended or adjusted under 35 U.S.C. 154(b) by 0 days.

(21) Appl. No.: 14/841,930

(22) Filed: Sep. 1, 2015

(65) Prior Publication Data

US 2017/0056746 A1 Mar. 2, 2017

(51) Int. Cl.

| | |
|---|---|
| ***A63B 69/20*** | (2006.01) |
| ***A63B 69/22*** | (2006.01) |
| ***A63B 69/24*** | (2006.01) |
| ***A63B 69/28*** | (2006.01) |
| ***A63F 7/20*** | (2006.01) |
| ***A63B 63/00*** | (2006.01) |
| ***A63B 67/06*** | (2006.01) |
| ***A63B 67/10*** | (2006.01) |
| ***A63B 69/00*** | (2006.01) |

(52) U.S. Cl.

CPC ..... *A63B 69/205* (2013.01); *A63B 69/004* (2013.01)

(58) Field of Classification Search

CPC ..... A63B 69/0079; A63B 69/0084; A63B 69/0091; A63B 69/20; A63B 69/201; A63B 69/203; A63B 69/205; A63B 69/206; A63B 69/208; A63B 69/24; A63B 43/00; A63B 43/007; A63B 67/10; A63B 7/00; A63B 7/02; A63B 7/04; A63B 7/045; A63B 7/08; A63B 69/105; F21V 21/02; F21V 21/03

See application file for complete search history.

(56) References Cited

U.S. PATENT DOCUMENTS

| | | | | | |
|---|---|---|---|---|---|
| 782,332 | A * | 2/1905 | Goldsmith | A63B 69/205 | 482/87 |
| 818,604 | A * | 4/1906 | Bierd | A63B 69/205 | 248/328 |
| 1,444,542 | A * | 2/1923 | Grossheim | A63B 69/205 | 248/317 |
| 4,257,589 | A * | 3/1981 | Outlaw | A61H 23/06 | 473/569 |
| 4,736,945 | A * | 4/1988 | Vinciguerra | A63B 5/20 | 285/396 |
| 5,171,019 | A * | 12/1992 | Arnette | A63F 9/02 | 273/332 |
| 6,406,407 | B1 * | 6/2002 | Wiedmann | A63B 5/20 | 482/81 |
| 7,252,607 | B2 * | 8/2007 | Gormley | A63B 43/007 | 473/423 |

(Continued)

*Primary Examiner* — Nyca T Nguyen

(74) *Attorney, Agent, or Firm* — The Olmsted Law Group, PLLC; Andrew Olmsted

(57) ABSTRACT

A striking device features an attachment mechanism releasably coupled to a length of cord for suspension of the device from an upper support. Featured along the cord is a mechanism for height adjustment, designed for insertion and removal from within the interior of a hollow striking object. The striking object remains attached to the height adjustment mechanism when struck, but is quickly detached by application of a force downward upon the top of the striking object. The entire device is designed for rapid assembly and disassembly and such that it is suitable for use within a home with lesser space requirements than other training devices on the market.

2 Claims, 4 Drawing Sheets

(56) References Cited

U.S. PATENT DOCUMENTS

| | | | | |
|---|---|---|---|---|
| 2010/0130312 | A1* | 5/2010 | Fuentes | A63B 69/0079 473/429 |
| 2012/0225740 | A1* | 9/2012 | Gibadlo | A63B 69/0071 473/423 |

* cited by examiner

DEVICE FOR COMBATIVE SPORTS TRAINING

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable

FIELD OF THE INVENTION

The present invention generally relates to exercise equipment and, more specifically, to exercise equipment used by participants in combative sports training. Even more specifically, the present invention relates to easily portable combative sports exercise equipment featuring height-adjustable striking objects designed for suspension by a cord, with a quick-release feature between the striking object, suspension cord and mount for safety, ease of disassembly and storage.

BACKGROUND OF THE INVENTION

Combative sports, training for combative sports and other closely related physical endeavors are common forms of exercise and self-defense dating back thousands of years. While any individual's particular training goals may vary, the overall goals of participants in these sports are to quickly and powerfully strike a moving target while improving hand-eye coordination, reaction time and overall physical endurance.

Many combative sports participants do not always wish to train against a human opponent. However, it is still desirable for a participant to engage with a moving target while training solo. As such, many devices have been created over the years to accommodate this desire. The most common devices disclosed in the prior art are commonly referred to as: the heavy punching bag, the speed bag, the reflex bag and variations thereof. Each device is useful for training in general, but by their design, poorly suited for home use. Primary shortcomings of devices found in the prior art are: the requirement of near-permanent attachment to a floor or ceiling; too heavy or cumbersome for an individual to move easily; and/or too large for convenient storage. Use of such devices often requires dedicated training rooms, with the result that the user has to either dedicate the majority of an average household room to training, or travel to gyms to train.

Therefore, there exists a need for a training device that may be quickly assembled and disassembled, that is easily moved and may be compactly stored, all while still remaining an effective training device for combative sports.

The inventor has performed a search of the prior art and believes the present invention is a new and useful invention for which patent protection is warranted.

SUMMARY OF THE INVENTION

Within the preferred embodiments, and the alternative embodiments disclosed herein, a striking object suspended from a height-adjustable suspension system is provided. The system allows the user to raise and lower the striking object as desired, change the striking object to one featuring alternative physical properties and strike the object from all sides and from below.

DETAILED DESCRIPTION OF THE INVENTION

Figure 1:
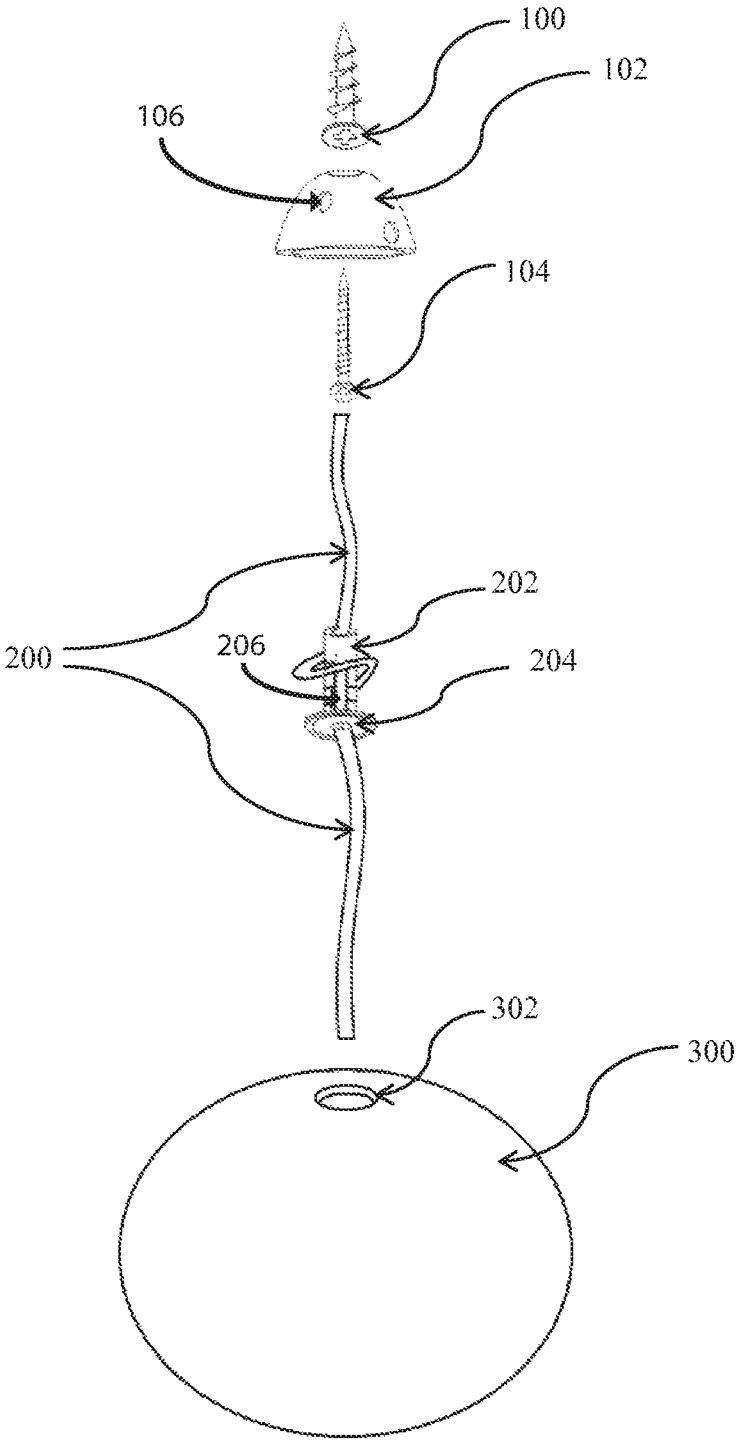
FIG. 1—exploded view of the preferred embodiment of the present invention.

Referring now to the exploded view of the invention as shown in FIG. 1 of the drawings, there is shown the terminal mount 100. The preferred embodiment of the present invention calls for, and the illustrations show for demonstrative purposes, the use of a sheetrock anchor as the terminal mount 100. Overall, the scope and spirit of the invention calls for ease of assembly. Therefore, the inventor does not wish to limit the terminal mount 100 to only a sheetrock anchor. For example, alternative embodiments would allow eyebolts or hook screws as suitable terminal mounts 100.

Still referring to FIG. 1, there is shown the cord attachment member 102. The preferred embodiment of the present invention calls for, and the illustrations show for demonstrative purposes, the use of a semi-spherical object containing holes 106 through which the cord 200 may be threaded as the cord attachment member 102. The preferred embodiment of the cord attachment member 102 of the present invention allows the cord 200 to pass through a hole 106 in the cord attachment member 102, wrap around the outer body of the cord attachment member 102 and thread back into the body of the cord attachment member 102. Quick release of the cord 200 from the cord attachment member 102 may be achieved by simply reversing this process.

Depending on the use of alternative means of attachment or objects for the terminal mount 100 than those shown in the illustrations, use of a cord attachment member 102 may not be necessary. In addition, the cord 200 may be knotted after passing through the cord attachment member 102 to secure the cord 200 if desired. Alternative embodiments of the present invention utilizing objects such as eyebolts or hook screws as the terminal mount 100 would allow direct attachment of the cord 200 to the terminal mount 100.

Still referring to FIG. 1, there is shown an attachment screw 104. The preferred embodiment of the present invention calls for, and the illustrations show for demonstrative purposes, use of an attachment screw 104 that runs through the center of the cord attachment member 102 into the terminal mount 100. In the preferred embodiment, the attachment screw 104 anchors the cord attachment member 102 into the terminal mount 100 on a user's ceiling or other suitable attachment surface. As discussed above, alternative embodiments of the present invention may not necessarily feature the attachment screw 104 or cord attachment member 102, though such alternatives remain within the spirit and scope of the claimed invention. Items 100 102 104 and 106 allow the present invention to mount to an upper surface and are a mounting system. Items 100 102 and 104 allow the present invention to be affixed to an upper surface and are a means of attachment to an upper surface. Items 102 and 106 allow the mounting system to accept a suspension cord 200 and are a means for attachment of a suspension cord.

Still referring to FIG. 1, there is shown the cord 200, the height adjustment member 202 and the striking object 300. The height adjustment member 202 allows the user to attach a striking object 300 along the cord 200 and is an attachment mechanism for the striking object 300. The striking object 300 is hollow, and may be made from any durable material of high elasticity, rubber being the preferred material. Alternative embodiments of the present invention allow for use of materials other than rubber. The striking object 300 features a hole 302 on its dorsal surface running through the outer wall of the striking object 300. The preferred embodiment of the present invention allows for a quick exchange of striking objects 300 to those of different sizes. For instance, a beginner may wish to utilize a larger striking object 300, as it would be easier to strike. As the user improves his skills, he may wish to utilize smaller striking objects 300 to fine tune striking accuracy. The scope and spirit of the claimed invention do not limit use of one particular shape or size of striking object 300, though the preferred embodiment calls for spheres, as the illustrations demonstrate.

The preferred embodiment of the present invention allows for users to insert the terminal mount 100 flush within the user's ceiling. The user may then utilize the attachment screw 104 to fasten the cord attachment member 102 into the terminal mount 100. The preferred embodiment of the mount assembly 100-104 calls for a width of less than two inches, with the height of the attachment member 102 less than half an inch. As such, the user may leave the entire (or only part of the) mount assembly 100-104 in place when not in use without it being so bulky as to be cosmetically unpleasing.

Figure 2:
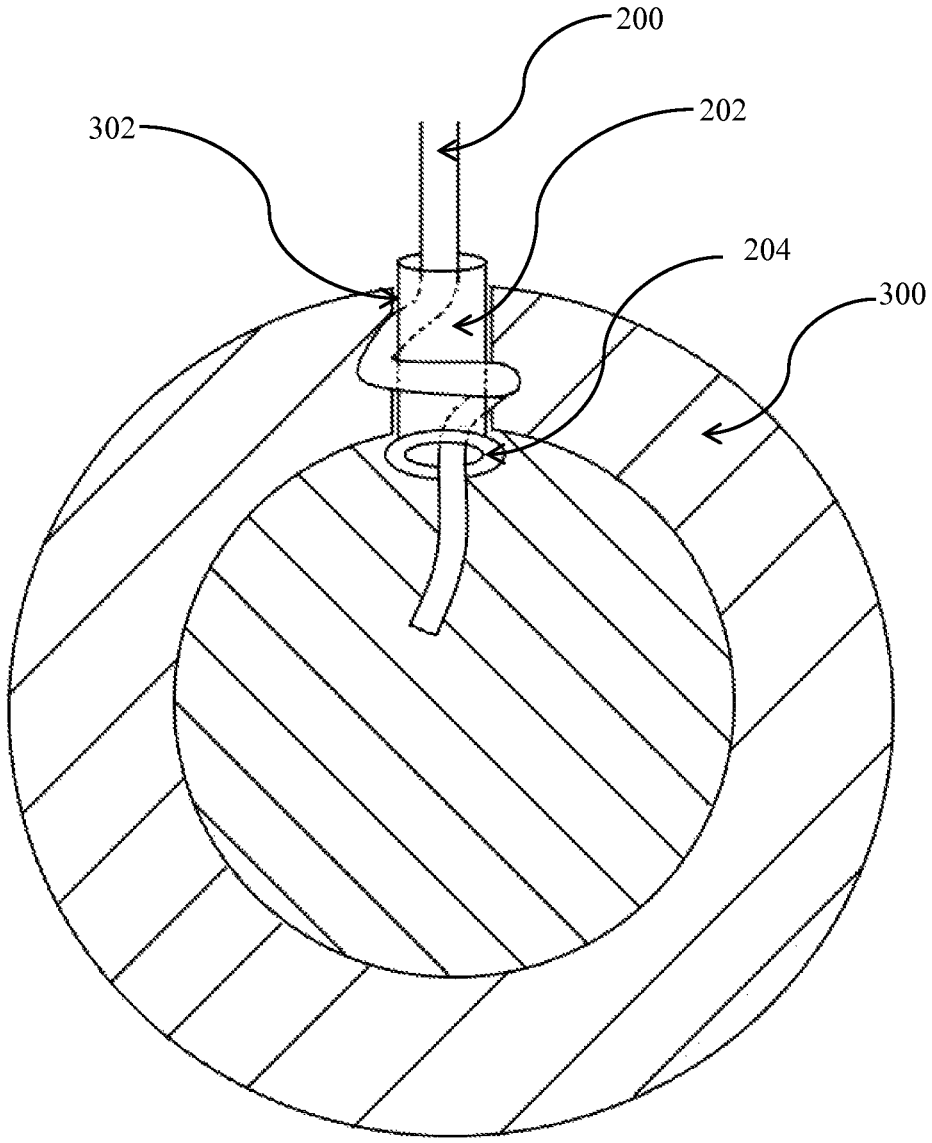
FIG. 2—sectional view of the lower portion of the present invention.

Referring now to FIG. 2, a sectional view of the striking object 300 is shown, showing storage of the lower tail end of the cord 200 within the striking object 300 when fully assembled. FIG. 2 also demonstrates the interaction between the height adjustment member 202 and the hole 302 through the internal walls of the striking object 300. FIG. 2 also shows the location of the lip 204 against the internal wall of the striking object 300 when assembled. Storage of the lower tail end of the cord 200 within the striking object 300 is an important aspect of the present invention. Many typical users will not want free cord 200 swinging about while training. This feature cures a common problem found in other devices on the market.

Referring now in more detail to the interaction between the height adjustment member 202 and the striking surface 300 as best shown by FIG. 2, the striking surface 300 features a hole 302. The preferred embodiment calls for the hole 302 to be roughly one-quarter inch in diameter. Whatever size hole 302 is used, the main body of the height adjustment member 202 features a lip 204 with a diameter slightly larger than the diameter of the hole 302. Alternative embodiments of the present invention may allow different size holes 302 and lips 204 while remaining within the scope and spirit of the invention as claimed, though the inventor believes the dimensions described above are the best mode of practice.

To attach the striking object 300 onto the cord 200, the user threads the end of the cord 200 distal to the mount assembly 100-104, and the height adjustment member 202 through the hole 302 into the striking object 300. The elastic nature of the striking object 300 and its hole 302 allow the lip 204 of the height adjustment member 202 to barely pass into the internal cavity of the striking object 300 when the hole 302 is stretched open. The elastic nature of the striking object 300 causes the hole 302 to constrict, fully enveloping the lip 204, and compress around the body of the height adjustment member 202.

An alternative assembly of the device allows for the lip 204 of the height adjustment member 202 to rest directly against the inner wall of the striking object 300, with the body of the height adjustment member 202 below the inner wall of the striking object 300 and below the lip 204.

Once the striking object 300 is attached onto the cord 200, the striking object 300 is securely suspended from the mount assembly 100-104. The interaction of the lip 204 within the inner walls of the striking object 300 is such that application of forces right to, acute to and obtuse to a line formed through the mount assembly 100-104 and the striking object 300 will not cause the lip 204 and height adjustment member 202 to eject from within the striking object 300. However, application of a force greater than roughly eight pounds downward onto the striking object 300 roughly parallel to the line discussed in the preceding sentence will cause the lip 204 to slightly expand the hole 302, allowing a quick release of the height adjustment member 202, lip 204 and cord 200 from within the striking object 300. This helps prevent damage to the surface upon which the mount assembly 100-104 is affixed, may help prevent injury to the user or others and aids in quick disassembly when desired.

Figure 3:
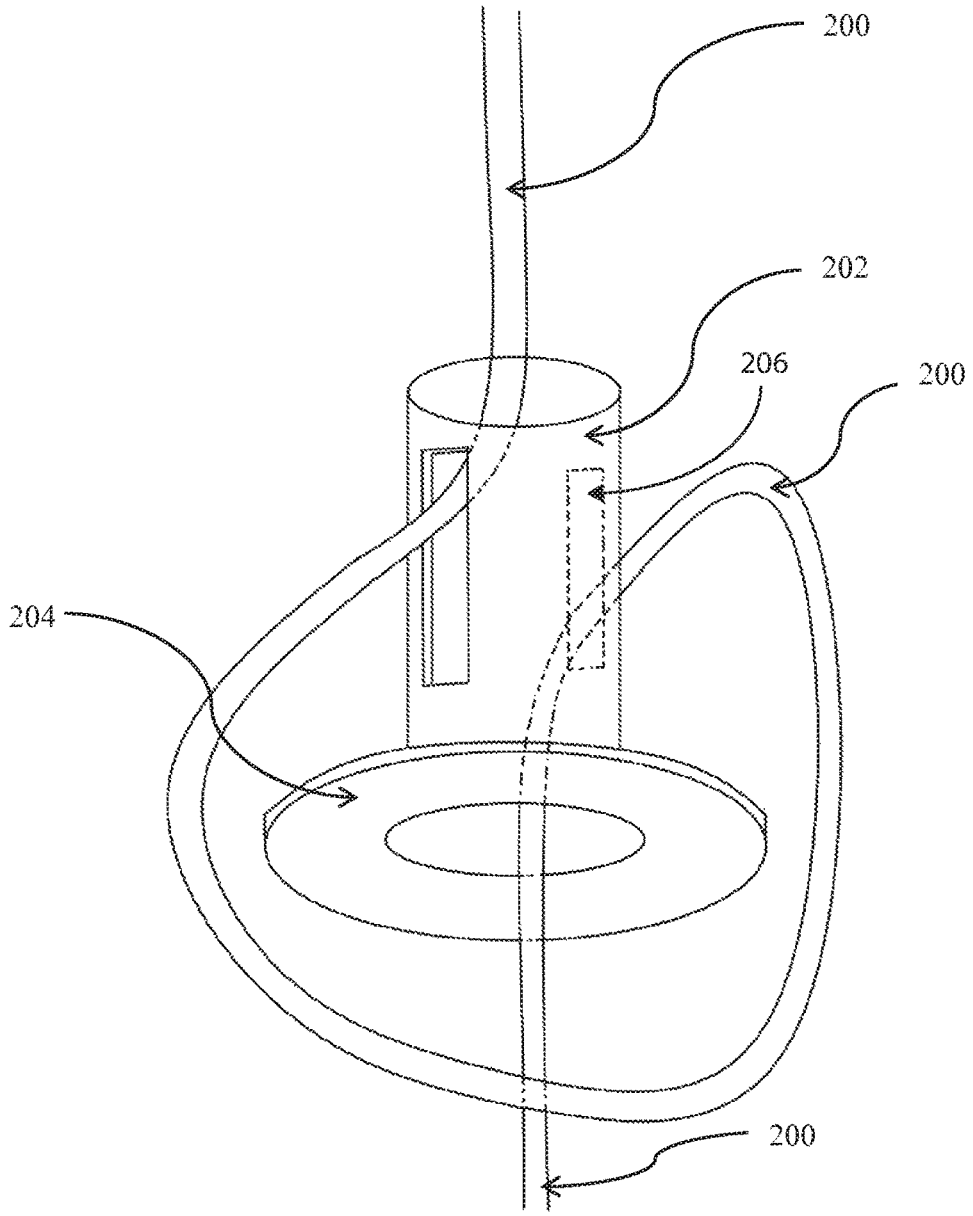
FIG. 3—closeup of the cord/height adjustment member assembly.
Figure 4:
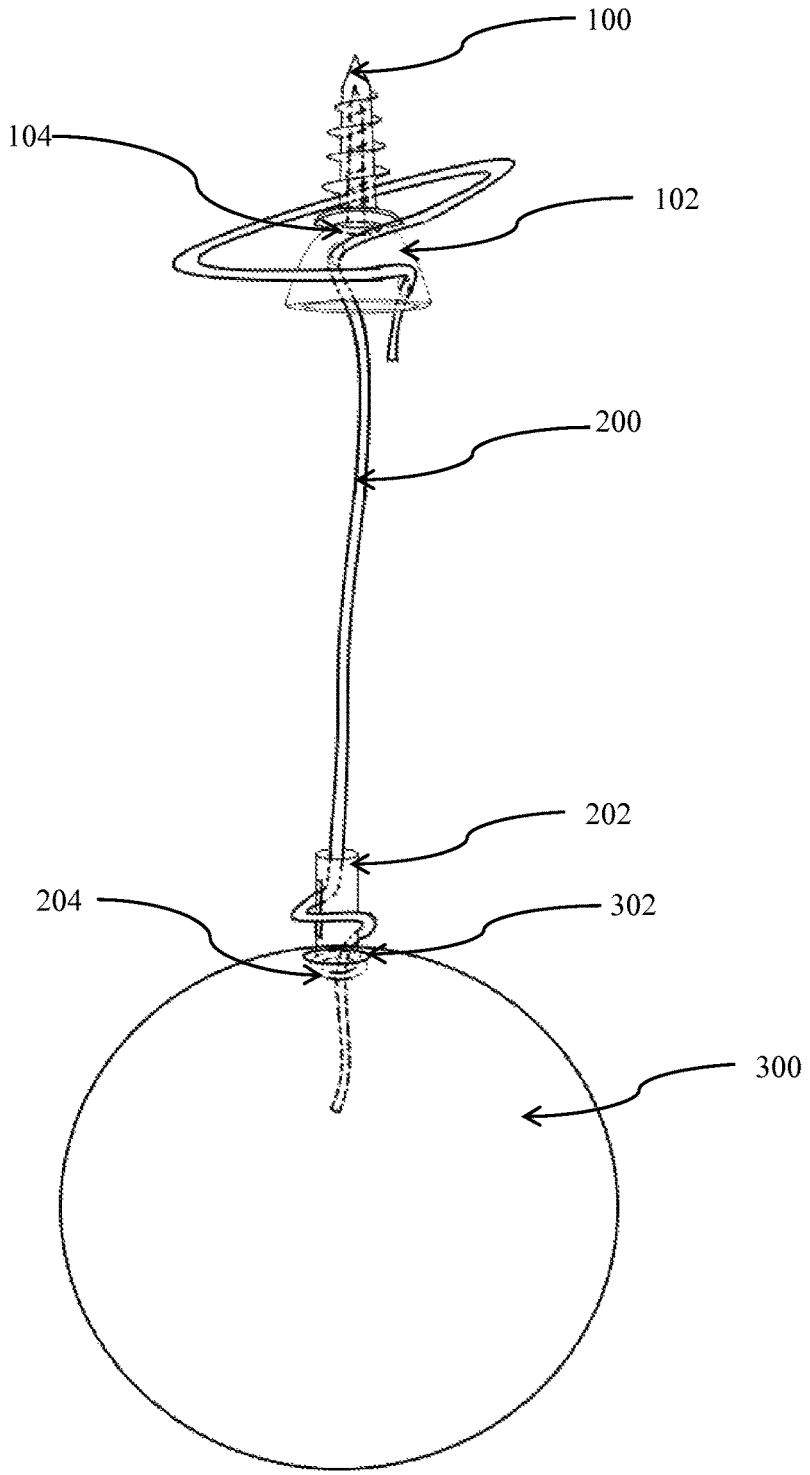
FIG. 4—assembled view of the present invention.

Referring now to FIG. 3, there is shown a magnified view of the cord 200, height adjustment member 202 and lip 204. The preferred embodiment of the height adjustment member 202 calls for hollow construction. The preferred embodiment of the present invention calls for the cord 200 to run downward from the mount assembly 100-104 into a hole on the portion of the height adjustment member 202 opposite the lower lip 204. The cord 200 exits a slit 206 on one lateral side of the height adjustment member 202, wraps around the outer body of the height adjustment member 202 and reenters the body of the height adjustment member 202 through another slit 206 on the opposite lateral side of the height adjustment member 202 as the first slit 206. Once the cord 200 is back within the body of the height adjustment member 202, the cord 200 is threaded through another hole within the lip 204 of the height adjustment member 202 and continues downward.

The effect of passing the cord 200 through the height adjustment member 202 is such that when there is slack cord 200 around the body of the height adjustment member 202, the height adjustment member 202 may be raised and lowered on the cord 200 by sliding the adjustment member 202 proximal or distal to the mount assembly 100-104 as desired. Once slack is removed from the cord 200 around the height adjustment member 202, the height adjustment member 202 is secured in place on the cord 200. The height adjustment member 202 is specifically designed so that when the slack of the cord 200 is removed from about the body of the height adjustment member 202, the height adjustment member 202 is secured in place on the cord 200. This is of particular importance when the present invention is fully assembled, as the user will not wish for slippage when training. As the height adjustment member 202 is able to travel vertically along the cord 200 when so desired, it functions as a means for vertical adjustment. The interaction between the cord 200 through the slits 206 of the height adjustment member 202 provides a means to secure the attachment mechanism at a height desired by the user.

The primary benefit of the interaction described directly above is that users are able to easily raise and lower the placement of the height adjustment member 202 about the cord 200, which, in turn, allows for situation of the striking object 300 at whatever height the user desires. Once the user sets the appropriate height of the striking object 300, it will stay at that height until the height adjustment member 202 is raised or lowered on the cord 200. Furthermore, the inventor believes the present invention is an improvement over the prior art, as the cord 200 is stored within the striking object 300, rather than passing entirely through, as found with other products on the market.

While the foregoing written description of the invention enables one of ordinary skill to make and use what is presently considered to be the best mode thereof, those of ordinary skill will understand and appreciate the existence of variations, combinations, and equivalents of the preferred embodiment and examples herein. The invention should therefore not be limited by the described embodiment, method, and examples, but by all embodiments and methods within the scope and spirit of the invention as claimed.

What is claimed is:

1. A device for combative sports training comprising:

a mounting system having a means for attachment to an upper surface with a means for attachment of a suspension cord distal to the point of attachment to the upper surface, wherein the means of attachment of the suspension cord of the mounting system is comprised of a hollow semi sphere body, featuring at least one hole passing horizontally through the dorsal surface of the semi sphere body, configured for attachment of the suspension cord, and at least one hole passing vertically through the body of the semi sphere, through which the means for attachment to the upper surface comprises a screw adapted to pass, allowing attachment to an upper surface, a suspension cord attachable to the mounting system, said cord extending vertically downward from the mounting system;

a one-piece attachment mechanism located along the cord, said attachment mechanism having a means for vertical adjustment along the suspension cord and a means to secure the attachment mechanism to the cord;

a hollow striking object, said striking object having at least one opening of suitable size and elasticity to allow a user to thread the end of the cord distal to the attachment mechanism, as well as the attachment mechanism, through the opening to couple the striking object to the attachment mechanism.

2. A device for combative sports training comprising:

a mounting system having a means for attachment to an upper surface with a means for attachment of a suspension cord distal to the point of attachment to the upper surface;

a suspension cord attachable to the mounting system, said cord extending vertically downward from the mounting system;

a one-piece attachment mechanism located along the cord, said attachment mechanism having a means for vertical adjustment along the suspension cord and a means to secure the attachment mechanism to the cord, wherein the attachment mechanism comprises a body that is hollow, with two slits opposite each other passing through the lateral surface of the body, and the body further comprising an upper opening for the cord to pass downward into the body of the attachment mechanism, out through one lateral slit of the two slits, around the body of the attachment mechanism, back into the body of the attachment mechanism through the other lateral slit of the two slits, exiting through the end of the attachment mechanism opposite the upper opening, allowing movement of the attachment mechanism along the cord by threading the cord through the body of the attachment mechanism and allowing for securing of the attachment mechanism along the cord by tightening of the cord about the body of the attachment mechanism;

a hollow striking object, said striking object having at least one opening of suitable size and elasticity to allow a user to thread the end of the cord distal to the attachment mechanism, as well as the attachment mechanism, through the opening to couple the striking object to the attachment mechanism.

* * * * *